United States Patent [19]

Tomczak

[11] Patent Number: 4,852,889

[45] Date of Patent: Aug. 1, 1989

[54] INSTALLATION FOR BALL GAME WITH RETURN PANEL

[76] Inventor: Bernard Tomczak, 5, rue du Muguet, 62490 Vitry en Artois, France

[21] Appl. No.: 227,828

[22] Filed: Aug. 30, 1988

[30] Foreign Application Priority Data

Aug. 12, 1987 [FR] France ..... 87 11621
Apr. 25, 1988 [FR] France ..... 88 05833

[51] Int. Cl.[4] ..... A63B 67/00

[52] U.S. Cl. ..... 273/411; 273/29 A; 273/395

[58] Field of Search ..... 273/411, 395, 396, 29 A

[56] References Cited

U.S. PATENT DOCUMENTS 3,580,578 5/1971 McCarthy ..... 273/411 X
4,478,420 10/1984 Sowards ..... 273/411

FOREIGN PATENT DOCUMENTS 234082 3/1960 Australia ..... 273/395
45346 2/1982 European Pat. Off. ..... 273/29 A
2574304 6/1986 France .

*Primary Examiner*—William H. Grieb
*Attorney, Agent, or Firm*—Shenier & O'Connor

[57] ABSTRACT

This invention relates to an installation for a ball game, of the football type, which comprises a rectangular playing pitch and at least one return panel made of a hard material whose outer surface is inclined towards the pitch. A preferred embodiment of the installation comprises a central obstacle, for example a net enveloping bows, dividing the pitch into two zones of equal surface area, and two panels placed along the sides of the pitch parallel to the central obstacle. Each of the two panels is constituted by four elements mounted on supports in the form of containers and assembled in two's. The two central elements are flat; the two lateral elements are incurved and are concave in the horizontal plane. In this way, any ball struck from the opponent zone onto the panel is returned by said panel onto the zone along which it is placed.

7 Claims, 1 Drawing Sheet

INSTALLATION FOR BALL GAME WITH RETURN PANEL

FIELD OF THE INVENTION

The present invention relates to a ball game, of the football type, and more particularly to an installation comprising at least one element for returning the ball.

BACKGROUND OF THE INVENTION

Patent FR-A-2 574 304 discloses a ball game installation equipped with return elements called "partners": these elements are nets of concave or convex profile, elastically fixed in a rigid frame. In view of the particular structure of this receiving and returning net, it will readily be appreciated that the return of the ball is a function of the elastic deformation both of the net and of the members for fixing the net on its frame. Such deformation is, moreover, a function of the striking force on the ball, the place of impact of the ball on the net and also the shape of the net. As emphasized on several occasions in this Patent, the angle of return of the ball by the net is virtually unforeseeable, in the same way as the force of return depends on the damping character of the net. Moreover, the concave or convex profiles of the net, which are illustrated, lead to a volley return of the ball which will allow continuous play without the ball touching the ground.

SUMMARY OF THE INVENTION

A ball game installation equipped with return elements has now been found, and this is the subject matter of the invention, in which the ball is returned in foreseeable manner and on the pitch. The installation is of the known type in that it comprises a rectangular pitch and at least one return element. According to the invention, the return element is a panel made of a hard material and the surface of said panel facing the pitch is overall inclined towards said pitch.

In this way, the ball bounces back in foreseeable manner, without damping due to the elasticity of the return element, and is returned towards the ground.

The return panel is preferably placed along one side of the pitch and its length is approximately equal to that of said side.

The surface of the return panel facing the pitch is preferably flat in its central part and, in the two lateral parts, presents a curved shape so that the ball coming from the pitch and striking the panel at any one of its points is returned onto the pitch. In a preferred embodiment, the panel is constituted by four rectangular elements of the same dimensions, equipped with fastening means cooperating for the assembly of said four elements two by two, the surface of the two central elements facing the pitch being flat and that of the two lateral elements being concave in the horizontal plane. It will be readily understood that the four elements, once assembled, form one single homogeneous panel, without discontinuity and that the concavity of the two lateral elements is inverted, forming a rounded whole facing the pitch.

The return panel, or the elements which compose it, is for example made from a composite material of glass fibers impregnated with polyester resin.

The return panel may be rigidly fixed in the ground on the pich where required; or it is advantageously removable, for example being fixed on a support in the form of a container adapted to receive a load. In this way, the panel and its support are light and easy to handle, and the stability of the panel once placed along the pitch is obtained by filling the container with a sufficient load for the panel to remain in place when struck by the wall.

When the panel is placed at a determined height above the pitch, the installation may comprise beneath the panel means for damping and recovering the ball, for example a net.

The installation according to the invention is preferably completed by a central obstacle dividing the pitch into two zones of equal surface area, and, in that case, it comprises two return panels placed along the two opposite sides of the pitch parallel to the central obstacle. According to this particular embodiment, the two return panels are fixed on supports at a determined height above the pitch which is a function of the height of the central obstacle. Moreover, the inclination of the panel, the incurvation of the surface of its lateral parts and the height of the central obstacle are such that the panel returns onto the zone along which it lies the ball coming from the other zone.

The central obstacle is advantageously made of a supple material capable of breaking the fall of a player without injuring him. According to a preferred embodiment, it comprises supports in the form of bows, aligned and fixed to the ground, and a covering net or cloth fixed on the bows and enveloping the volume constituted by the alignment of said bows.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
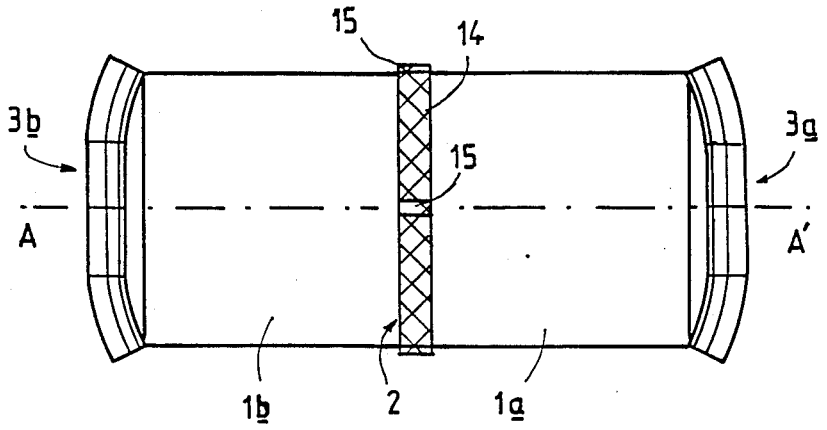
FIG. 1 is a schematic plan view of the installation.

Referring now to the drawings, the installation according to the invention comprises a rectangular playing field or pitch fourteen meters long and five meters wide, comprising two zones 1*a* and 1*b* of equal surface area (7 meters by 4 meters) defined by the central obstacle 2 placed at the centre of the pich parallel to the sides of the pitch along which two return panels 3*a* and 3*b* are positioned.

Each return panel 3 is an assembly of four modular panels 4, 5, 6, 7 of rectangular shape measuring 1.20 meter high and 1.25 meter wide. Each of these modular panels is mounted on a support 8 by means of two vertical uprights 9 and 10 located at the lateral ends of the panel. The maximum height of the panel is equivalent to that of a football goal, i.e. of the order of 2.20 meters. The support 8 is a container which extends beneath the corresponding modular panel, placed flat on the ground and adapted to receive a load, such as water or cement. An upper horizontal flange 16 is provided along the upper edge of the modular panel, as well as a vertical lateral reinforcement 17 on each side of the panel, in order to improve solidity of the removable modular assembly constituted by panel 4, 5, 6, 7 and its support 8. A net 11 for damping the ball is stretched between uprights 9 and 10.

Figure 2:
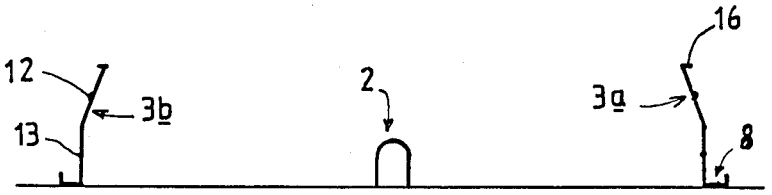
FIG. 2 is a schematic view in section of the installation along axis AA' of FIG. 1.
Figure 3:
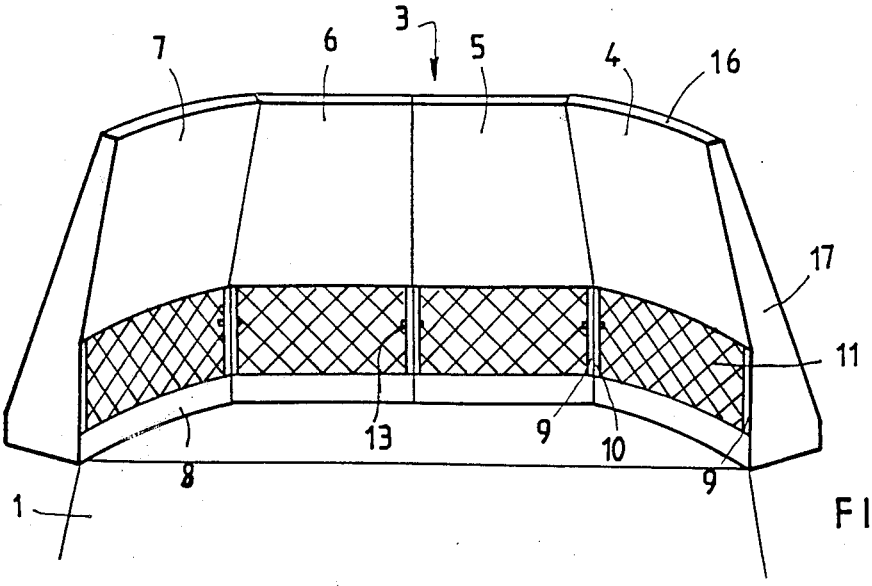
FIG. 3 is a schematic front view in perspective of the return panel.

The four modular panels 4, 5, 6, 7 are slightly inclined, of the order of 20°, with respect to the vertical, the upper part of the panel advancing towards the pitch more than the lower part, as is clearly illustrated in FIG. 2.

The surface of the two central panels 5 and 6 facing the pitch is flat. The surface of the two lateral modular panels 4 and 7 facing the pitch is slightly incurved in a horizontal plane, in a concave curve. Such incurvation is inverted for one and the other of the two lateral modular panels 4 and 7, so that the two ends of the return panel 3 are rounded in form towards the pitch.

The modular panels are made of a rigid composite material based on glass fibers reinforced with polyester resin. A rigid panel is thus obtained, ensuring adequate bouncing of the ball, but sufficiently light for the removable assembly to be easy to handle. Moreover, this material withstands bad weather. Means 12 for fastening the modular panels in two's and 13 for fastening the vertical uprights in two's ensure assembly and stability of the whole. Such fastening means are of any known type, for example cotter pins cooperating with orifices made through the uprights and positioned opposite one another during assembly.

The central obstacle 2 is a net 14 stretched over the outer part of three supports 15 in the form of bows, two supports placed along the pitch and the third in the middle of the pitch along axis AA' of FIG. 1. The three supports 15 are in line with one another, the bows being parallel, so that the net 14 envelops a volume which corresponds to a rectangular parallele-piped surmounted by a semi-cylinder. The maximum height of the net is of the order of 80 cm, for a ground width of 90 cm. The net 14 is an obstacle for the ball; due to its structure, it does not present any risk of injury for the player who might fall thereon.

The invention described hereinabove is used under the following conditions: two players or two groups of players are on the pitch, in zones 1*a* and 1*b* respectively. When playing, they send the ball, by kicking or heading, from their zone 1*a* towards the opponent zone 1b above the net 14. When the ball is sent by a player from zone 1*a* onto the panel 3*b* of the opponent zone 1*b*, the ball is returned by the panel 3*b* onto the pitch of zone 1*b* whatever the point of impact of the ball on the panel 3*b*, due to the geometry of the panel 3*b* and its rigid structure for bounce-back. The return of the ball is foreseeable by the player of zone 1*b*, knowing where the ball is coming from and assessing the striking force; consequently, this player may position himself on the return path of the ball from the panel 3*b* and send it towards zone 1*a* once said ball has bounced on the ground of zone 1*b*. Of course, the game in question, played with the aid of this installation, has rules which do not have to be explained here but which advantageously exploit the particular properties of the return panels and the presence of the central obstacle, which have just been recalled.

The invention is not limited to the embodiment of the invention which has just been described, but covers all the variants thereof. In particular, one single return panel may be placed along a training ground, allowing a single player to use the installation. The dimensions of the pitch, the height of the panels and of the central obstacle are adapted to the conditions of the game, for children or adults, etc.

What is claimed is:

1. A ball game installation comprising a rectangular playing field, a central obstacle having a determined height and dividing the field into two zones of equal surface area, two return panels placed along the two opposite sides of the field parallel to the central obstacle, the return panel length being approximately equal to that of said side, each return panel being made of a hard material having its surface facing the field inclined toward said field, and each return panel being flat in its central part and curved in its two lateral parts so that a ball coming from one zone of the field and going over the central obstacle and striking the panel placed in the other zone is returned onto that other zone of the field.

2. An installation as in claim 1 wherein each return panel is made up of four rectangular elements of the same dimensions and fastening means for securing adjacent elements to each other, the surface of the two central elements facing the field being flat and the surfaces of the two lateral elements facing the field being concave in the horizontal plane.

3. An installation as in claim 1 wherein each return panel is made of a composite material of glass fibers impregnated with polyester resin.

4. An installation as in claim 1 wherein each return panel is fixed on a support in the form of a container adapted to receive a load.

5. An installation as in claim 1 wherein each rturn panel is located at a height above the field determined as a function of the height of the central obstacle, said installation comprising means beneath each panel for damping and recovering the ball.

6. An installation as in claim 5 wherein said damping and recovering means is a net.

7. An installation as in claim 1 wherein the central obstacle comprises supports in the form of bows aligned and fixed to the ground and a covering net or cloth fixed on the bows and enveloping the volume formed by the alignment of the bows.

* * * * *

UNITED STATES PATENT AND TRADEMARK OFFICE

CERTIFICATE OF CORRECTION

PATENT NO. : 4,852,889

DATED : August 1, 1989

INVENTOR(S) : Bernard Tomczak

It is certified that error appears in the above-identified patent and that said Letters Patent is hereby corrected as shown below:

Col. 4, Claim 2, line 34, change "surface" to --surfaces--.

Col. 4, Claim 5, line 44, change "rturn" to --return--.

Signed and Sealed this

Eighth Day of May, 1990

*Attest:*

HARRY F. MANBECK, JR.

*Attesting Officer*

*Commissioner of Patents and Trademarks*